United States Patent [19]

Blum

[11] 4,279,239

[45] Jul. 21, 1981

[54] WOOD-FIRED FIREPLACE

[75] Inventor: Jean Blum, Obernai, France

[73] Assignee: Supra Fabrique d'Appareils de Chauffage et de Cuisine, S.A., Obernai, France

[21] Appl. No.: 98,319

[22] Filed: Nov. 28, 1979

[30] Foreign Application Priority Data

Dec. 6, 1978 [FR] France ..... 78 34987
Dec. 6, 1978 [FR] France ..... 78 34988

[51] Int. Cl.[3] ..... F24B 1/18

[52] U.S. Cl. ..... 126/120; 126/121; 126/142; 126/164

[58] Field of Search ..... 126/120, 121, 138, 139, 126/143, 142, 243, 164; 237/51

[56] References Cited

U.S. PATENT DOCUMENTS

| | | | |
|---|---|---|---|
| 2,707,464 | 5/1955 | Gillen | 126/121 |
| 2,863,443 | 12/1958 | Hoffman | 126/121 |
| 3,151,611 | 10/1964 | Tuttle | 126/121 |
| 4,016,859 | 4/1977 | Landowski | 126/120 |
| 4,076,011 | 2/1978 | Proulx | 126/121 |
| 4,126,118 | 11/1978 | Haynes | 126/121 |
| 4,174,700 | 11/1979 | Bartsch | 126/121 |
| 4,214,570 | 7/1980 | Hansmeyer | 126/121 |
| 4,233,956 | 11/1980 | Haynes | 126/121 |
| 4,236,498 | 12/1980 | Taliaferra | 126/120 |

FOREIGN PATENT DOCUMENTS

| | | |
|---|---|---|
| 1242342 | 6/1967 | Fed. Rep. of Germany . |
| 7138168 | 10/1971 | Fed. Rep. of Germany . |
| 2365089 | 7/1975 | Fed. Rep. of Germany . |
| 2405140 | 8/1975 | Fed. Rep. of Germany . |
| 2510438 | 9/1975 | Fed. Rep. of Germany . |
| 631881 | 12/1927 | France . |
| 1191803 | 5/1970 | United Kingdom . |

*Primary Examiner*—James C. Yeung
*Assistant Examiner*—Larry Jones
*Attorney, Agent, or Firm*—Young & Thompson

[57] ABSTRACT

A wood-fired fireplace comprises a fire basket with log-retaining dogs, a back plate, a glass door, an upper part connected to a flue and provided with an anti-downdraft device, and a sweeping flap. A damper is operable by a lever, and an ashpan is raised upon a protection sheet. A hood has a hot air outlet grill, and there are means and ducts for regulating the admission and flow of combustion air and convection air.

5 Claims, 5 Drawing Figures

33
30
29
5
28
30
8
32
7
31
26
44
3
10
11
27
9
45
2
6
23
48
24
18
30
47
1
46
25
4
17
21

WOOD-FIRED FIREPLACE

INTRODUCTION AND BACKGROUND OF THE INVENTION

The present invention relates to indoor wood-fired fireplaces, and has for object such a fireplace which is prefabricated and has a high heating efficiency.

Currently existing fireplaces are generally permanently fixed and are either entirely built in or are constituted by an assembly of prefabricated elements such as hearth, chimney throat and hood.

These known fireplaces are most frequently high in cost price and necessitate adaptation work for the walls of the premises where they are fitted. Moreover for such fireplaces a special flue is practically always necessary.

Further none of these fireplaces presents any possibility of dismantlement and therefore they are not practical for installation in rented property.

Finally the heat output of the existing fireplaces is very low, since only the radiation heat is utilised.

The present invention has the purpose of remedying these drawbacks.

BRIEF SUMMARY OF THE INVENTION

The invention has for object a prefabricated wood-fired fireplace of high heating efficiency which is constituted essentially by a fire-grate of refractory cast iron, a cast iron half-plate, an upper half element likewise of cast iron equipped with a smoke outlet which can be fitted to existing flues, a deflector disposed beneath the smoke outlet and provided with an anti down-draught device and a sweeping flap, an ash pan placed beneath the lower part of the fireplace forming a curb support, this pan being separated from the floor by a protective metal sheet, and this lower part being provided with at least one convection air inlet, a refractory glass hearth door forming a spark guard, an insulation on the wall or walls of the fireplace which are applied against the building walls, and a hood the support cross-piece of which on the upper hearth element is offset towards the front of the said element forming an air inlet between the upper hearth element and the cross-piece, and which is further provided with a sliding box permitting its adaptation to the height of the room and also with a removable dust extraction filter placed in the upper part of the hood.

The invention will be explained in greater detail hereinafter by means of a preferred form of embodiment given by way of non-limitative example which is explained with reference to the accompanying diagrammatic drawings.

BRIEF DESCRIPTION OF THE VIEWS IN THE DRAWINGS

DETAILED DESCRIPTION OF THE PREFERRED EMBODIMENT

Figure 1:
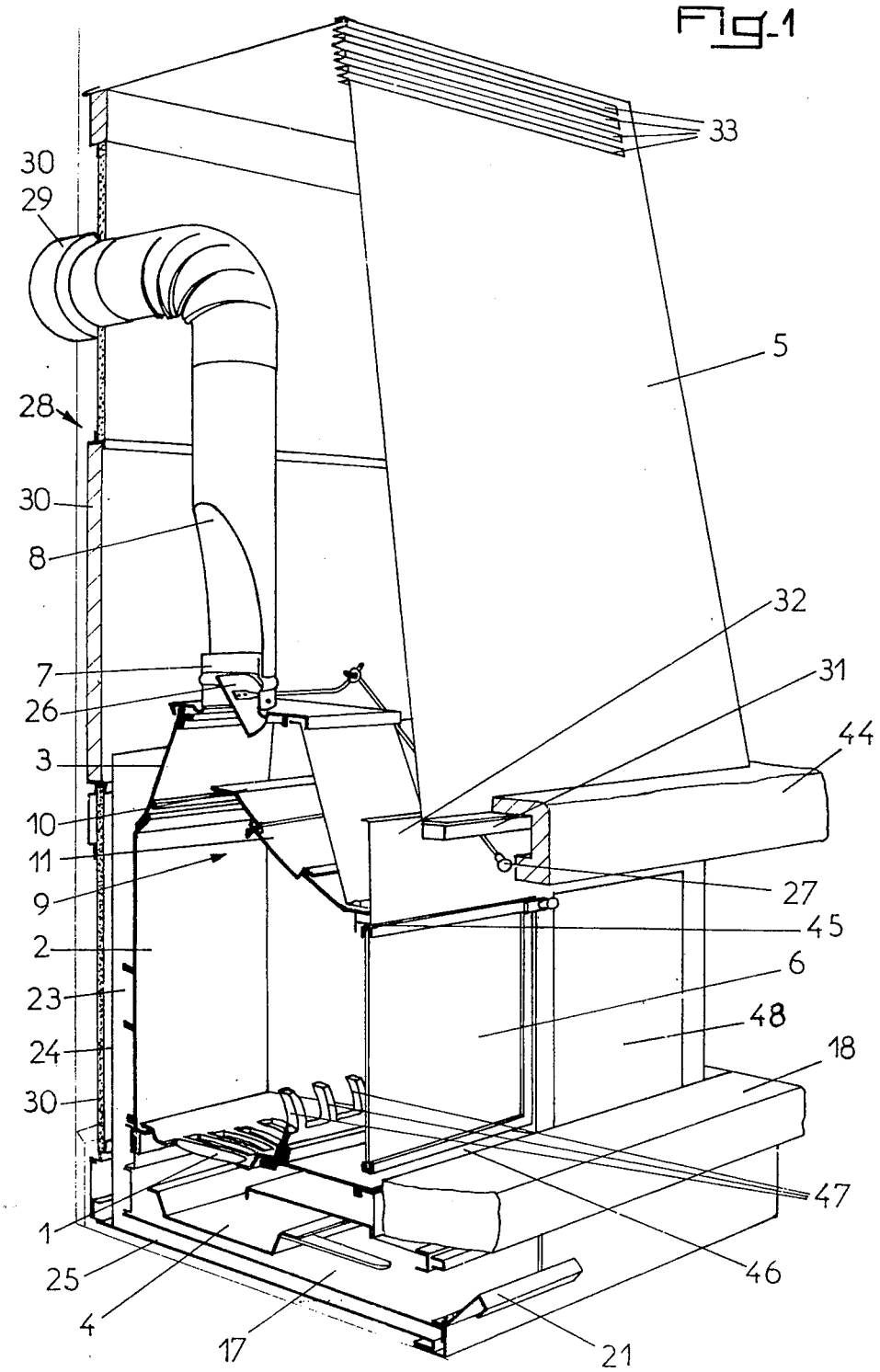
FIG. 1 is a perspective and sectional view of a fireplace according to the invention.

In accordance with the invention and as shown more particularly by way of example by FIG. 1 of the accompanying drawings, the prefabricated wood-fired fireplace is constituted essentially by a fire-grate 1, a hearth plate 2, an upper hearth element 3, an ash pan 4, a hood 5 and a hearth door 6.

The fire-grate 1, the hearth plate 2 and the upper hearth element 3 are advantageously made of refractory cast iron.

The upper hearth element 3 is provided with a smoke outlet 7 which can be fitted to existing flues 8, and beneath this smoke outlet 7 a deflector 9 is provided. The latter is equipped with an anti-down-draught device 10 and a sweeping flap 11 disposed beneath the anti down-draught device 10 in the central part of the deflector 9.

Figure 4:
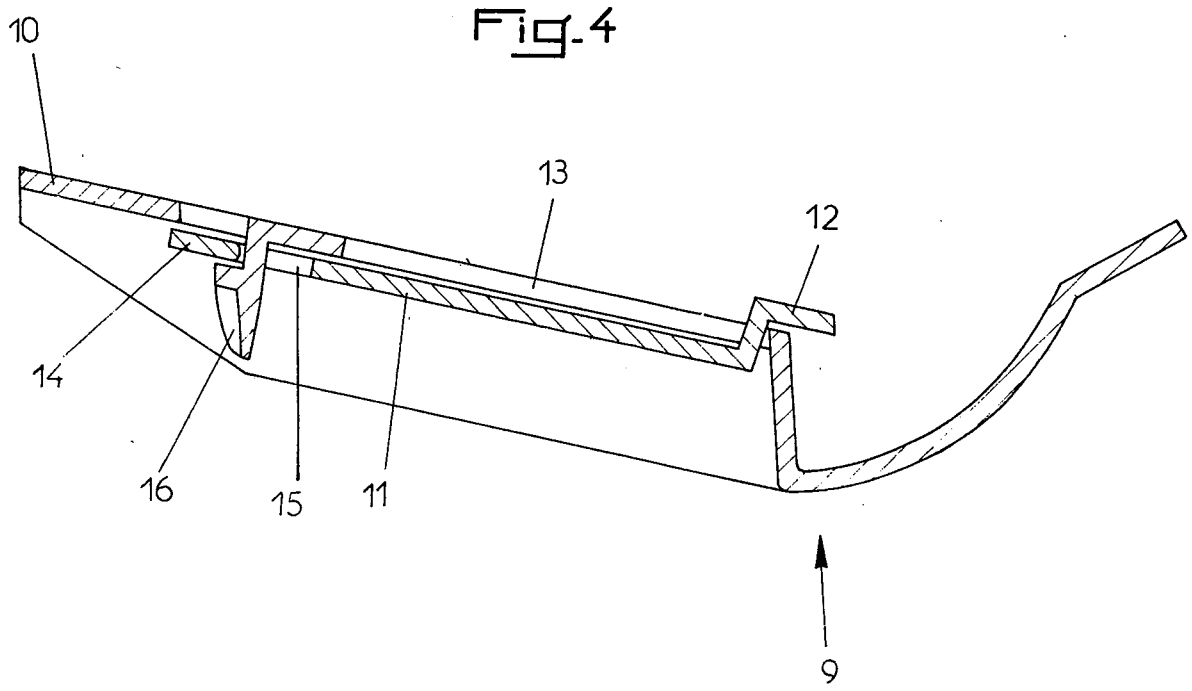
FIG. 4 is a sectional view on a larger scale of the deflector according to the invention.

This sweeping flap 11 is equipped with a longitudinal retaining lug 12 which engages in the sweeping trap 13, and with a fixing lug 14 having a piercing 15 for the passage of a hook-shaped retaining appendage 16 of the deflector 9 (FIG. 4).

Figure 2:
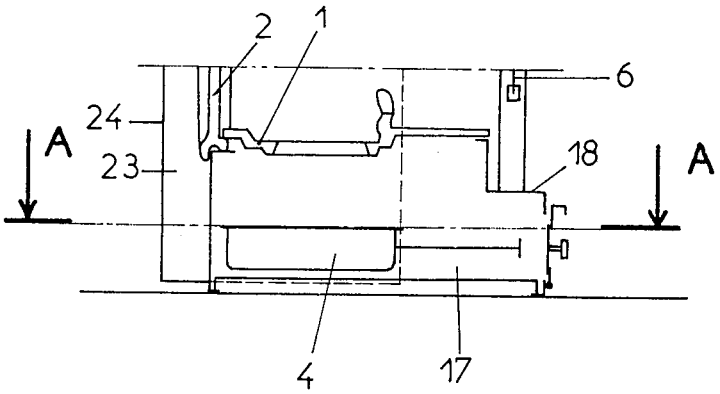
FIG. 2 is a partial sectional view of the fireplace hearth.
Figure 3:
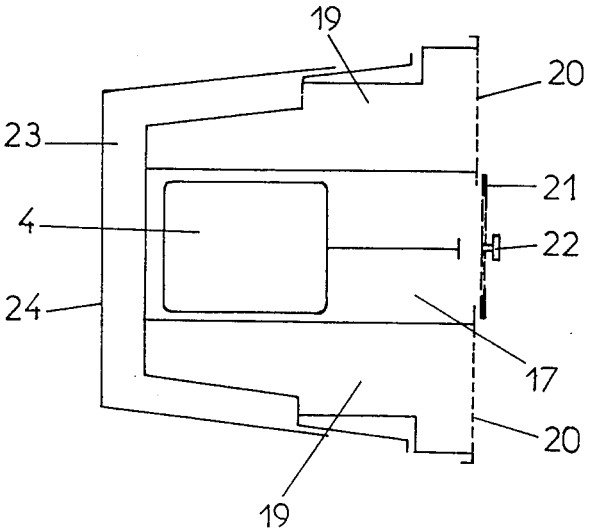
FIG. 3 is a sectional view along the line A—A in FIG. 2.

The ash pan 4 is lodged in a compartment 17 of the lower part of the fireplace which at the same time forms a support for the curb 18, and this compartment 17 is surrounded on both sides by an air circulation conduit 19 connected to an air admission opening 20 provided on the front face of this lower part. The compartment 17 is further closed by a door 21 equipped with a primary air admission regulation flap 22. The air circulation conduits 19 each open behind the hearth plate 2 and on the hearth sides into a space 23 defined by an air guidance skirt 24 which surrounds the hearth plate 2 and the hearth curves (FIGS. 2 and 3). Finally the compartment 17 is provided in its lower part with a metal sheet 25 for protection of the floor against heat (FIG. 1).

The smoke outlet 7 is equipped with a damper 26 operable by means of a lever 27 and on the flue 8 which is connected to the outlet 7, at the level of the fireplace wall which is applied against the building wall, there is provided a heat-insulating sleeve 29.

The fireplace wall 28 applied against the building wall is kept spaced from the latter by the edges of the lateral walls, and it is constituted by insulating panels 30. In the case of corner fitting the two application walls of the fireplace are equipped with such panels. This arrangement of the application wall against the building wall ensures a fresh air circulation between the fireplace wall 28 and the said building wall.

The hood 5 is mounted above the upper hearth element 3 on a support cross-piece 31 which is offset towards the front of the element 3, forming a convection air inlet space 32, and this air can issue from the hood 5 in its upper part through one or more hot air exit grills 33. This hood 5 is entirely removable and can be made of any material whatever, especially of sheet steel or copper.

Figure 5:
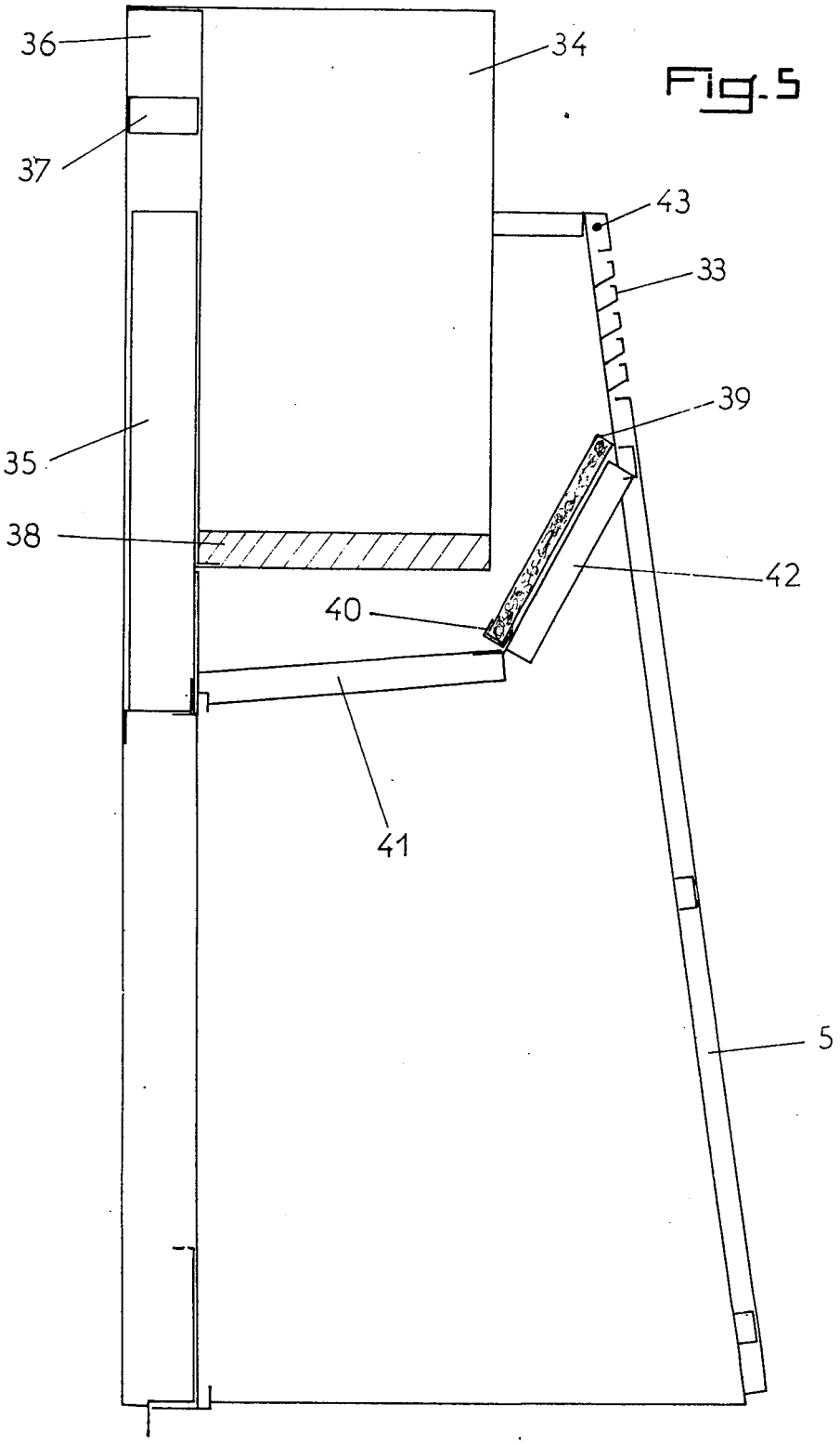
FIG. 5 is a view in lateral elevation and section, on a larger scale of the hood.

To permit adaptation of the fireplace to any room heights, the hood 5 is provided with a sliding box 34 mounted on two vertical longitudinal members 35 on its rear part by means of two channel members 36. These channel members 36 are guided on the longitudinal member 35 and the holding of the box 34 in position, after its height adjustment, is effected by means of one or more fixing stirrups 37 which have previously been sealed into the wall against which the fireplace is fitted. In its lower part, facing the smoke flue 8, the box 34 is provided with an insulating element 38 (see FIG. 5).

The hood 5 is further equipped in its upper part with a dust extraction filter 39 lodged with its lower part in a channel element 40 extending transversely of the hood 5 and forming part of a partial closure plate 41 which extends from the rear face of the hood 5 to the vicinity of the front face. The dust extraction filter 39 moreover rests with its sides on two profiled elements 42 fast with the sides of the hood 5. Access to the filter 39 is rendered possible by means of a pivot 43 of the hood 5 which permits of pivoting the hot air outlet grill 33.

Finally the hood 5 can be covered in its lower part by a decorative piece 44, such as a beam or any other decorative element (FIG. 1).

The hearth door 6 of refractory glass forms a spark guard, is provided in its upper part with a sealing joint 45 and is offset from the lower part of the hearth, forming therewith a secondary combustion air admission slot 46, this air serving at the same time to cool the glass of the door 6 (FIG. 1). This door 6 permits good regulation of the draught and connection of the hearth to an existing flue, since it is presented in the form of a closed hearth.

The fire-grate 1 is advantageously shaped in the form of a basket and provided in its forward part with dogs 47 intended to retain the logs so that they do not roll against the glass constituting the door 6 (FIGS. 1 and 2).

In operation the deflector 9 directs the flames towards the rear of the hearth so as to prevent them from licking around the glass of the door 6, and the anti down-draught device 10 prevents downward wind gusts from arriving directly on the hearth.

The soot deposited on the deflector 9 can easily be cleared away by simply withdrawing the sweeping flap 11.

In operation of the fireplace according to the invention a double convection air circulation is produced, namely on the one hand beneath the hearth 1 and around the hearth plate 2 and the curves of the hearth, and on the other above the upper hearth element 3, the two hot air currents obtained being then able to escape at the upper part of the hood 5 through the hot air outlet grill 33, or equally to be collected by means of a known distribution pipe device for heating through the intermediary of heating outlets. In the case of a hot air outlet through the grill 33, the air is deflected by the partial closure plate 41 and is filtered by the dust extraction filter 39.

By reason of the constitution of the fireplace according to the invention it is possible to utilise the hearth alone and equip it with any packaging according to the desire of the user, a curb support and a hood support forming integral parts of the said hearth, so that fitting of the fireplace is facilitated.

Finally according to a further characteristic of the invention and as shown in FIG. 1, the prefabricated wood-fired fireplace can be provided beside the hearth with a place 48 permitting storage of logs.

The lower part forming the heating assembly of the fireplace according to the invention can be entirely assembled in the works, in order to permit rapid delivery and positioning and connection in the manner of a wood stove, ready for operation, it being possible for the hood 5 to be delivered separately and fitted after connection of the lower part, or to be replaced by a masonary hood or other, formed in accordance with the wishes of the user.

Apart from its rapid installation, the fireplace according to the invention permits of effectively heating a room, by reason of the double circulation of convection air.

Moreover by reason of its constitution the fireplace according to the invention has a high heating efficiency, namely of the order of 55 to 60%, which is comparable with that of a stove and very clearly superior to that of existing open-fire fireplaces, while retaining the attractiveness of the latter.

The invention is not of course limited to the form of embodiment as described and represented in the accompanying drawings. Modifications remain possible, especially from the point of view of the constitution of the various elements, or by the substitution of technical equivalents, without thereby departing from the scope of protection of the invention.

What is claimed is:

1. A prefabricated, wood-fired fireplace of high heating efficiency, characterised in that it is essentially constituted by a fire-grate (1) of refractory cast iron, advantageously of basket form equipped in its forward part with dogs (47) intended to retain the logs, a hearth plate (2) of refractory cast iron, an upper hearth element (3) likewise of refractory cast iron, equipped with a smoke outlet (7) adaptable to existing flues (8) and provided with a damper (26) operable by means of a lever (27), a deflector (9) disposed beneath the smoke outlet (7) and provided with an anti down-draught device (10) and a sweeping flap (11) disposed beneath the anti down-draught device (10), an ash pan (4) lodged in a compartment (17) of the lower part of the fireplace which at the same time forms a support for a curb (18), the pan (4) being separated from the ground by a heat protection metal sheet (25) and this lower part being provided with at least one convection air inlet (20), a hearth door (6) of refractory glass forming a spark guard, provided in its upper part with a sealing joint (45) and offset from the lower part of the hearth forming therewith a secondary combustion air admission slot (46), insulation (30) on at least one of the walls of the fireplace (28) which are applied against the building wall or walls, the insulated wall being kept spaced from the building wall or walls by the edges of the other fireplace walls, a hood (5) which can be covered in its lower part with a decorative piece (44) such as a beam or any other decorative element, the support cross-piece (31) of which on the upper hearth element (3) is offset forward from the said element forming a convection air inlet space (32) between the upper hearth element (3) and the support cross-piece (31), and likewise serves as support for the decorative piece (44), the fireplace being provided for the one part with a sliding box (34) permitting its adaptation to the height of the room and equipped in its lower part with an insulation element (38), and for the other part with a removable dust extraction filter (39) placed in the upper part of the hood (5) beneath the sliding box (34), the hood further being provided in its upper part with at least one hot air outlet grill (33) which can be pivoted about a pivot (43) of the hood (5), the fireplace.

2. A fireplace according to claim 1, characterised in that the sweeping flap (11) is provided with a longitudinal retaining lug (12) engaging in a sweeping trap (13) and with a fixing lug (14) having a piercing (15) for the passage of a hook-shaped retaining appendage (16) of the deflector (9).

3. A fireplace according to claim 1, characterised in that on each side of the compartment (17) of the ash pan (4) there is provided an air circulation conduit (19) connected to the air inlet (20) provided on the front face of the lower part of the fireplace, in that the compartment (17) of the ash pan (4) is closed by a door (21) provided with a primary air admission regulation flap (22), and in that the air circulation conduits (19) each open behind the hearth plate (2) and on the sides of the hearth into a space (23) defined by an air guidance skirt (24) which surrounds the hearth plate (2) and the curves of the hearth.

4. A fireplace according to claim 1, characterised in that the sliding box (34) of the hood (5) is provided with two vertical channel members (36) guided on vertical longitudinal members (35) of the rear part of the hood (5), the retention of the sliding box (34) in position after its height adjustment being effected by means of one or more fixing stirrups (37) previously sealed into the wall against which the fireplace is applied.

5. A fireplace according to claim 1, characterised in that the dust extraction filter (39) is lodged with its lower part in a channel element (40) extending transversely of the hood (5) and forming part of a partial closure plate (41) which extends from the rear face of the hood (5) to the vicinity of the front face, the dust extraction filter (39) further resting by its sides on two profiled elements 42) fast with the sides of the hood (5).

* * * * *